US005547091A

United States Patent [19]

Neveras et al.

[11] Patent Number: 5,547,091

[45] Date of Patent: Aug. 20, 1996

[54] DISPENSING CONTAINER SNAP HINGE CLOSURE

[75] Inventors: George J. Neveras, Kendall; James C. McKinney, Cranbury, both of N.J.; Adam Sherman, Brooklyn, N.Y.; Richard L. Lohrman, Grayslake; David Ziegenhorn, Lake Zurich, both of Ill.

[73] Assignee: Colgate-Palmolive Company, New York, N.Y.

[21] Appl. No.: 973,810

[22] Filed: Nov. 9, 1992

Related U.S. Application Data

[63] Continuation-in-part of Ser. No. 800,173, Nov. 27, 1991, abandoned.

[51] Int. Cl.[6] ..... B65D 51/18; B65D 37/00

[52] U.S. Cl. ..... 215/237; 215/343; 220/259; 222/212; 222/545

[58] Field of Search ..... 215/237, 235, 215/238, 343; 220/256, 259, 335, 337, 339; 222/212, 545, 556, 562, 107

[56] References Cited

U.S. PATENT DOCUMENTS

| | | | |
|---|---|---|---|
| 1,370,665 | 3/1921 | Moore . | |
| 1,442,440 | 1/1923 | Messinger . | |
| 1,928,445 | 9/1933 | Boyd | 221/60 |
| 1,978,455 | 10/1934 | Geerlings | 221/60 |
| 2,789,717 | 4/1957 | Demke | 215/235 |
| 2,921,716 | 1/1960 | Schiller | 222/92 |
| 3,231,156 | 1/1966 | Schultz | 222/569 |
| 3,503,544 | 3/1970 | Setera | 222/556 |
| 3,933,271 | 1/1976 | McGhie | 220/335 |
| 4,193,519 | 3/1980 | Dubach | 222/111 |
| 4,377,247 | 3/1983 | Hazard et al. | 215/235 X |
| 4,386,714 | 6/1983 | Roberto | 220/339 |
| 4,403,712 | 9/1983 | Wiesinger | 220/339 |
| 4,503,991 | 3/1985 | Joyce | 220/339 |
| 4,615,462 | 11/1986 | Sacnerer | 220/339 |
| 4,625,898 | 12/1986 | Hazard | 222/517 |
| 4,638,916 | 1/1987 | Beck | 215/235 |
| 4,693,396 | 9/1987 | Tavss et al. | 222/107 |
| 4,723,671 | 2/1988 | Mears | 215/228 |
| 4,739,906 | 4/1988 | Loturco | 222/153 |
| 4,778,071 | 10/1988 | Fillmore | 215/237 |
| 4,793,501 | 12/1988 | Beck | 215/235 |
| 4,793,502 | 12/1988 | Beck | 215/235 |
| 4,848,612 | 7/1989 | Beck | 215/235 |
| 4,854,473 | 8/1989 | Dubach | 220/335 |
| 4,911,324 | 3/1990 | Dubach | 220/339 |
| 4,964,539 | 10/1990 | Mueller | 222/94 |
| 5,007,505 | 4/1991 | Beck | 220/339 |
| 5,065,876 | 11/1991 | Joyce | 215/206 |
| 5,148,912 | 9/1992 | Nozawa | 220/339 |
| 5,203,838 | 4/1993 | Schneider | 215/253 |
| 5,207,657 | 5/1993 | Gibilisco | 220/256 X |

FOREIGN PATENT DOCUMENTS

| | | | |
|---|---|---|---|
| 2355818 | 5/1975 | Germany | 215/235 |
| 2224309 | 5/1990 | United Kingdom . | |

OTHER PUBLICATIONS

Sample of Snap Hinge Cap Used on Dentifrice Dispensers of Colgate–Palmolive Company.

*Primary Examiner*—Allan N. Shoap
*Assistant Examiner*—Nathan Newhouse
*Attorney, Agent, or Firm*—Michael J. McGreal

[57] ABSTRACT

A closure for a container having a dispensing nozzle include a central aperture to receive the nozzle. In one embodiment, the nozzle extends through the aperture and projects upwardly from the base cap. The base cap further includes a top wall inclined with respect to the central axis of the base cap to assist in dispensing of the contents of the container. A cap lid is hinged to the base cap by a snap hinge assembly.

15 Claims, 6 Drawing Sheets

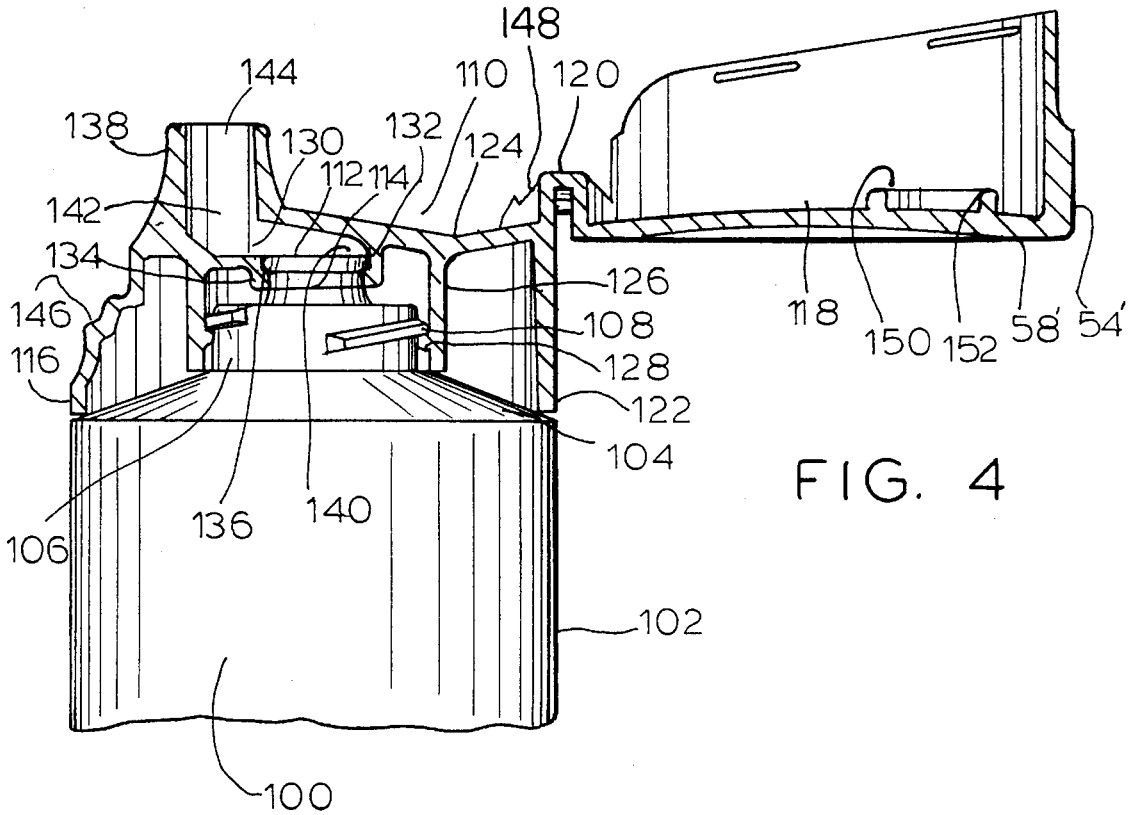
FIG. 4
FIG. 5
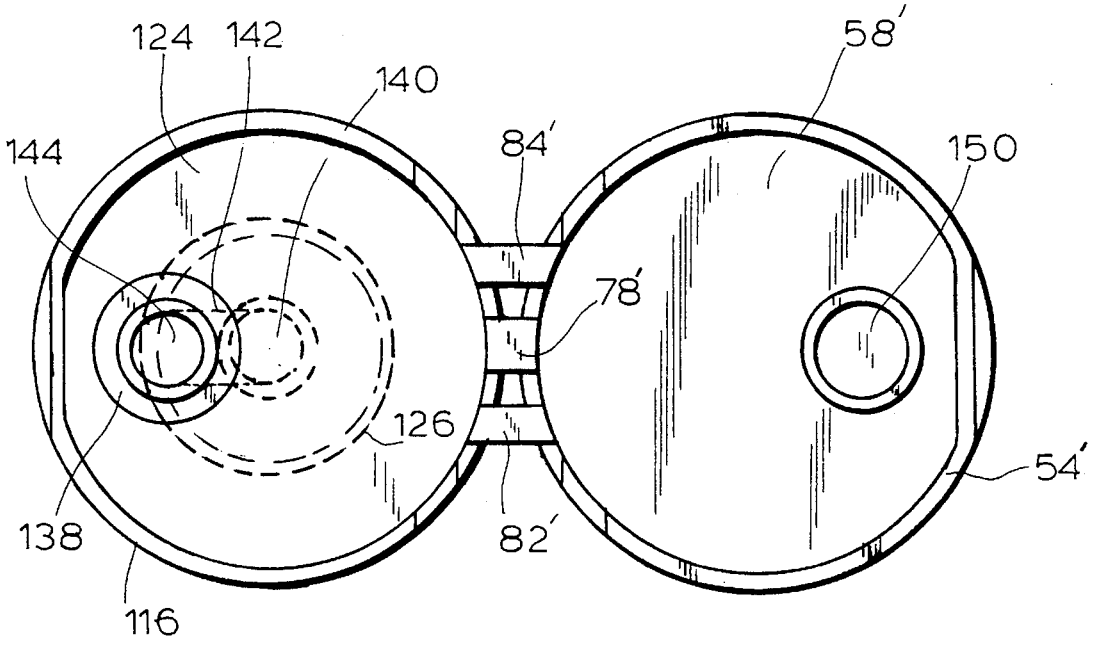

DISPENSING CONTAINER SNAP HINGE CLOSURE

This application is a continuation-in-part of U.S. application Ser. No. 07/800,173 filed Nov. 27, 1991, now abandoned.

FIELD OF THE INVENTION

This invention relates to a closure for a dispensing container and in particular a collapsible tube. More particularly, this invention is directed to a closure for mating with a dispensing nozzle on a container for the delivery of a product. The invention further relates to a closure having a product exit aperture offset from the centerline of the nozzle of the tube and closure.

BACKGROUND OF THE INVENTION

It is generally preferred that conventional containers such as squeeze tubes include a snap hinge closure to allow easy opening and closing of the container by the consumer. In this way the cap which closes the container after each use is not separated from the container. When a cap is separated from a container there is the likelihood that the cap can become misplaced. Thus, it is desirable that the cap remain attached to the container when the product is being dispensed from the tube. This form of closure is sometimes referred to as a captive cap.

The dispensing containers and closures are often used with viscous materials such as a dentifrice. Dentifrice compositions experience unique problems which are not found in other materials. One such difficulty in storing dentifrices is the container material must include a suitable barrier layer to prevent absorption of the flavor components and oils. Since the closure remains in contact with the dentifrice for extended periods of time, it is important to minimize the surface area of the cap contacting the dentifrice.

The type of closure that is usually preferred by the consumer is one where the closure is connected to a base by a snap hinge. This form of closure typically includes a hinge where the closure will be biased to an open position during dispensing and biased to a closed position during other times. Although biased to a closed position when product is not being dispensed, a manual force is usually required to snap the cap onto the base to fully close the tube and to seal the exit orifice.

Closures for a tube with a snap hinge have been used in the art for several years. One of the earliest closures of this type is shown in U.S. Pat. No. 1,928,445 which discloses a rubber hinge connecting a cap to a base portion. The base is a threaded annular shaped member attached to a threaded dispensing outlet of a tube. The cap portion is hinged to the base and can be manipulated from a closed position to seal off the outlet of the tube to a fully open position. This closure has a rubber film hinge attached to a base and cap that will bias the cap either in an open position or in a closed position.

Another form of a captive cap for a tube is shown in U.S. Pat. No. 3,933,271. This cap has a base portion attached to the tube and a cap portion connected to the base by a snap hinge. When the cap is opened to a point less than the intermediate position, the cap is biased closed. When the cap is pivoted open to a position past the intermediate position, the cap is biased open. The hinge design provides for this unique action of the cap.

Another type of film hinge for use in connection with a closure is shown in U.S. Pat. No. 4,403,712. This closure has the feature of the cap portion either being biased open or closed. This cap has the added feature that the cap portion is in a closed position, the film hinge is within the profile of the cap. A different type of closure with a snap hinge is shown in U.S. Pat. No. 4,503,991. This is a two part snap hinge to connect the cap to the base. The portion of the closure which seals the dispensing opening of the container has a projection that will fit down into the dispensing opening. The use of a double hinge provides this snap hinge closure with added versatility.

U.S. Pat. No. 4,615,462 discloses an addition example of snap hinge. This hinge is comprised of a main joint and two secondary joints. The main joint stabilizes the cap and base portion while the secondary joints provide the snap action. This is not a film hinge and the hinge parts will not be within the profile of the cap closure when in a closed position. U.S. Pat. No. 4,854,473 discloses a related closure where the hinge is also of a three piece structure. In this closure, the hinge is also of a three piece structure. In this closure, the hinge of the closure will be within the profile of the base cap when the cap lid is in a closed position.

These patents evidence the present state of the art of snap hinge closures for tubes. However, there is not shown a closure that is adapted for use with a tube having a nozzle nor one which has the exit for the delivery of product offset from the centerline of the tube. Further, there is not shown a snap hinge cap that is sufficiently large that the tube can stand on the cap and where the surface of the dispensing part of the cap is angled in order to provide for easier delivery of product. This latter feature is important with regard to toothpastes where the toothpaste is delivered onto a brush. This provides for easier delivery onto a brush. A further advantage is that the cap can be used as a captive cap or as a removable cap, thus satisfying more users.

SUMMARY OF THE INVENTION

The present invention is directed to a closure that is adapted to accept the nozzle of a container such as a squeeze tube. The closure includes a base cap and a cap lid hinged to the base cap by a snap hinge. In preferred embodiments, the base cap includes internal threads which mate with threads on the tube to attach the base cap to the tube. A central opening is included in the base cap to define an axial passage for the contents of the tube.

In one embodiment of the invention, the nozzle of the container extends axially through the base cap and projects above the upper surface of the base cap. A lip on the central opening in the base cap snaps into an annular groove in the nozzle. The cap lid includes an axial collar extending inwardly to engage the end of the nozzle and seal the nozzle when the cap lid is in the closed position.

In an alternative embodiment, the closure includes a dispensing nozzle and the container includes a spout which seals against the inner face of the cap lid.

In a further embodiment, the base cap includes an inner annular wall to define a central outlet channel, a horizontal conduit extending from the inner annular wall to an axial discharge nozzle which is spaced from the central axis of the base cap. The inner annular wall includes a lip which snaps into engagement with a groove in the nozzle.

BRIEF DESCRIPTION OF THE DRAWINGS

Referring to the drawings which form a part of this original disclosure:

FIG. 4 is a cross-sectional view of a closure in accordance with a second embodiment showing the delivery channel offset from the centerline of the tube.

FIG. 5 is a top plan view of the closure of FIG. 4.

DETAILED DESCRIPTION OF THE INVENTION

The disadvantages and limitation of the previous closures are obviated by the present invention while providing an efficient and simple closure for a dispensing outlet of a container. In a preferred form of the invention, the closure is used in conjunction with a dispensing container such as a collapsible, squeeze tube, flexible squeeze bottle or other container which may have an optional pump or valving arrangement. The container preferably has a dispensing outlet spout or nozzle with external threads for coupling with a closure.

The present invention is particularly directed to a closure for use with a squeeze container such as tube 10 comprising a base cap 32 and a cap lid portion 34.

Figure 1:
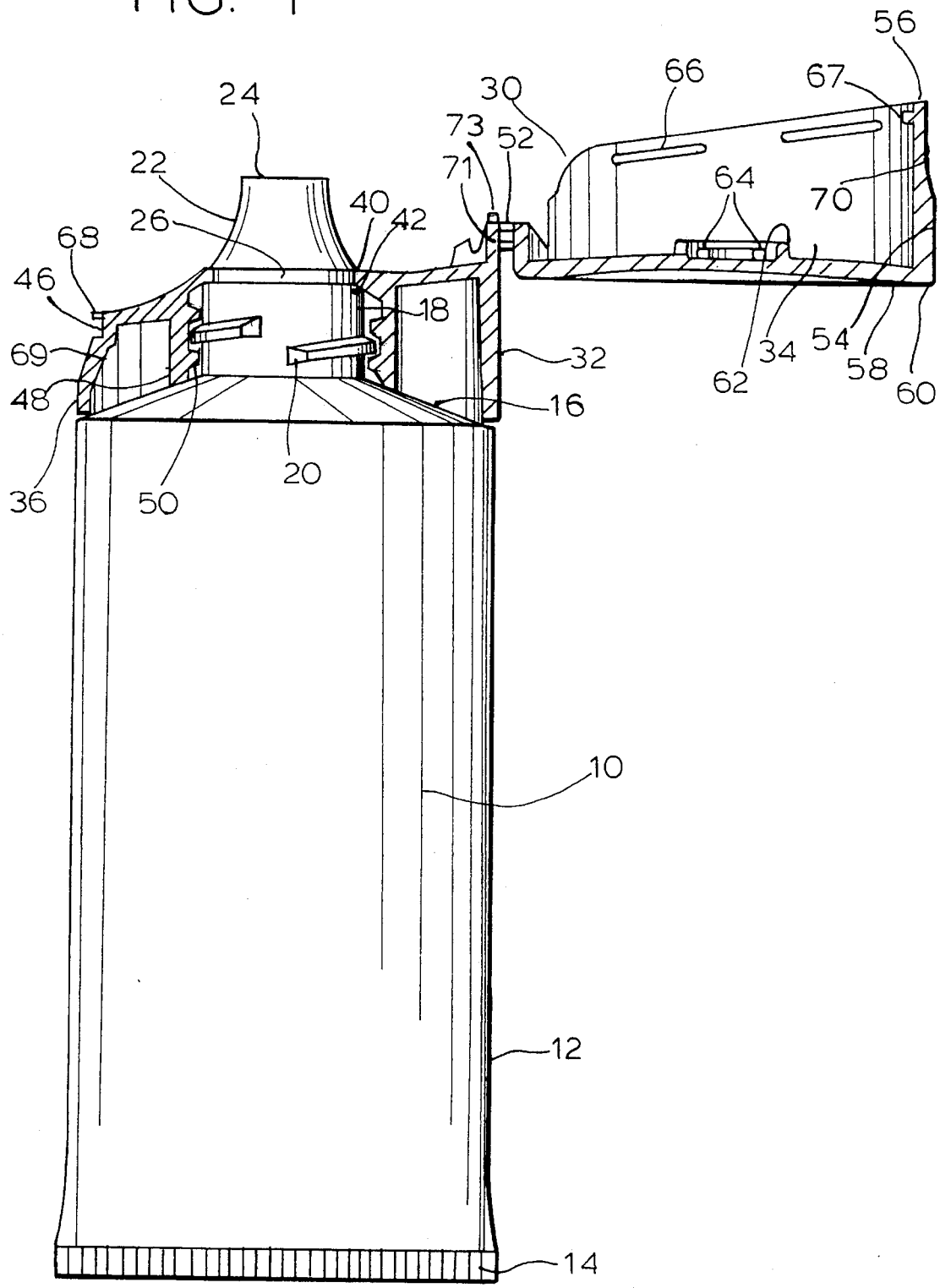
FIG. 1 is a cross-sectional view of the closure and a tube having a dispensing nozzle.

Referring to FIG. 1, the tube 10 includes a side wall 12 to define a body of the tube. The overall shape of the tube resembles a conventional squeeze tube which collapses as the contents of the tube are dispensed. The tube has a generally circular cross-section and is closed at the bottom by a straight seam 14. Typically, the tube is formed from a flexible plastic film material, although other materials such as metal foils may be used. When the tube is formed of a plastic material, the bottom seam 14 is formed by welding.

The container and closure assembly of the invention is particularly suitable for use in dispensing dentifrices such as toothpastes and gels. The container will preferably include a barrier layer on the inner surface of the container to prevent absorption of the flavor components and oils from the dentifrice. The nozzle or spout on the container will typically include the barrier layers since the nozzle is usually formed simultaneously with the tube. The arrangement of the closure assembly as discussed hereinafter in greater detail has minimal contact with the dentifrice and thus generally does not include a barrier layer.

The tube 10 also includes a top portion defining an inclined, conical-shaped shoulder 16. Toward the apex of the shoulder 16 is a dispensing nozzle including a cylindrical section 18 disposed concentric with a central axis of the tube and extending upward from the shoulder 16. A plurality of threads 20 are provided on the outer surface of the cylindrical section for coupling with the closure 32 as discussed hereinafter in greater detail. A tapered dispensing outlet nozzle 22 extends from the axial end of the cylindrical section 18 to define an outlet 24 from the tube. Disposed between the nozzle 22 and the cylindrical section is an annular groove 26. In the embodiment of FIG. 1, the nozzle 22 has a substantially frusto-conical shape with slightly concave side walls, although in alternative embodiments the nozzle may be a frusto-conical shape with straight walls. The nozzle 22, cylindrical section 18 and the shoulder 16 are integrally formed with the tube 10 in preferred embodiments. In alternative embodiments, the nozzle 22 and cylindrical section 18 may be manufactured as an assembly and attached to the tube 10 by welding or by an adhesive.

The nozzle 22 as shown in FIG. 1 is concentric with the central axis of the tube 12 and extends from the end of the tube a distance sufficient to facilitate dispensing of the contents of the tube. The nozzle 22 preferably extends from the shoulder 16 of the tube about 0.75 to 2.0 cm. The dispensing outlet 24 from the nozzle 22 generally defines an annular axial opening having a diameter of about 3 mm to about 10 mm. The dimension of the outlet 24 is generally not critical so long as the contents of the tube can be easily dispensed by squeezing the tube. The nozzle portion 22 allows the contents of the tube to be dispensed a distance from the normal point of delivery of the tube.

Figure 2:
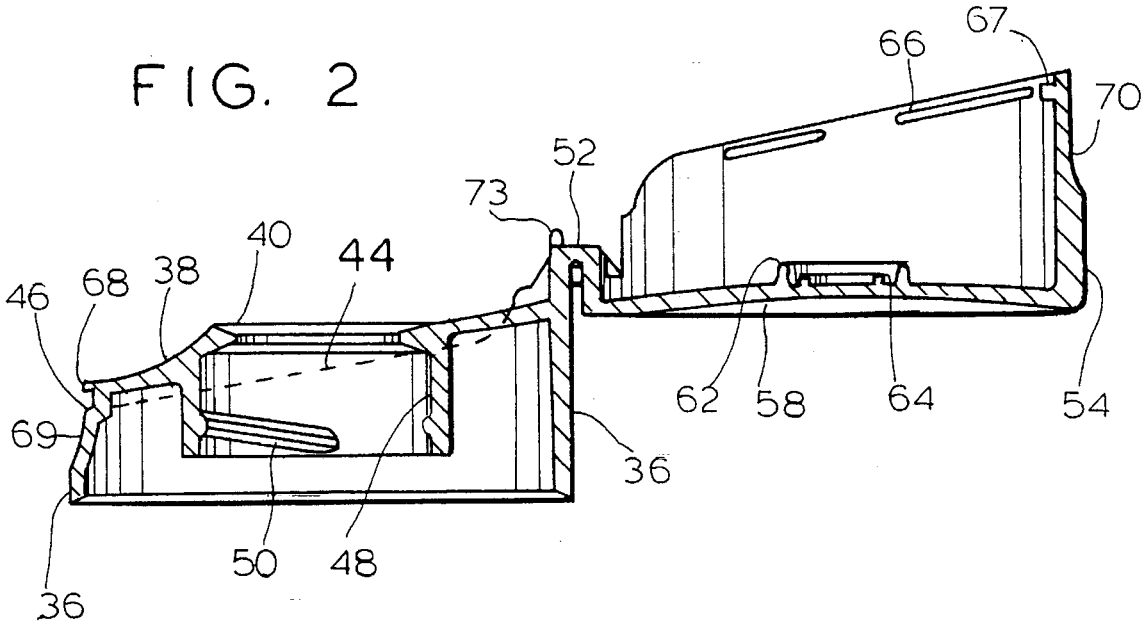
FIG. 2 is a cross-sectional view of the closure of FIG. 1.
Figure 3:
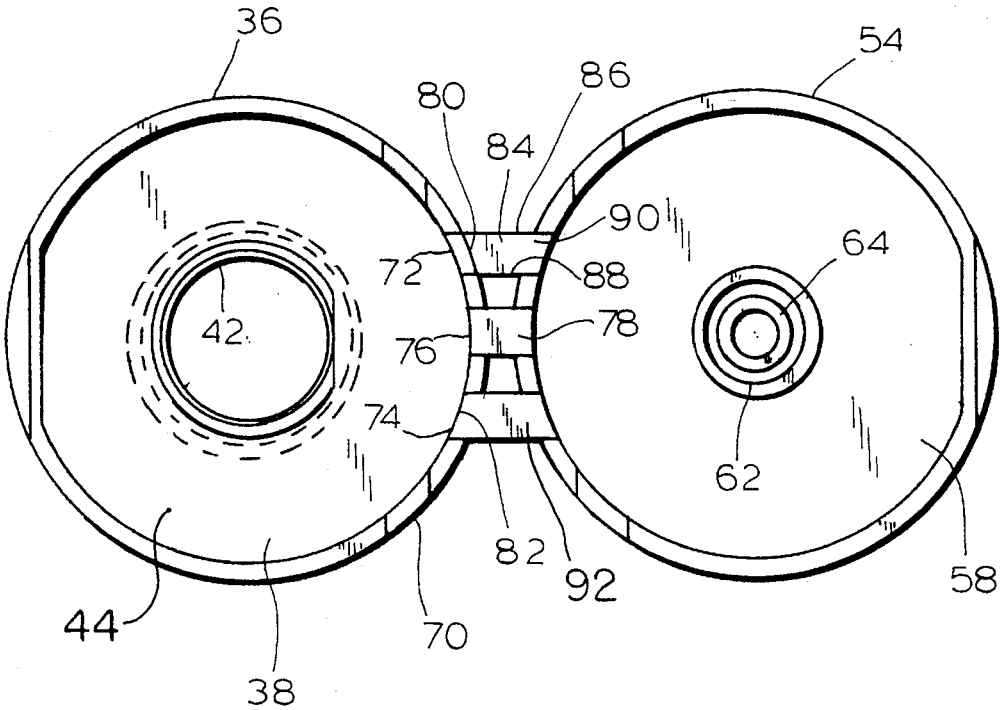
FIG. 3 is a top plan view of the closure of FIG. 1 in the open position.

The closure 30 according to a first preferred embodiment comprises a base cap 32 and an cap lid 34 hinged to the base cap. The base cap 32 has a generally cylindrical shape as shown in FIGS. 2 and 3. The base cap 32 includes an outer cylindrical wall 36 depending from a top end wall 38. The outer wall 36 in preferred embodiments is dimensioned the same size as the outer diameter of the tube 10 such that when the base cap 32 is positioned on the tube 10, the outer wall 36 is essentially flush with the wall 12 of the tube.

In the embodiment of FIG. 1, the top end wall 38 has a central opening 40 coaxially aligned with the central axis of the base cap 32. The opening 40 defines an annular lip 42 projecting radially inward toward the center of the base cap 32. In alternative embodiments, the annular lip may be spaced slightly below the upper edge of the base cap and may be discontinuous to form a plurality of detents. In preferred embodiments, the annular lip 42 is substantially perpendicular to the central axis of the base cap. The major portion of the top wall 38 defines an inclined surface 44. A ledge 46 extends around the perimeter of the inclined surface 44 to mate with the edge of the outer cap 34.

An inner annular wall 48 depends from the bottom surface of the top wall 38 and is concentric to the central axis of the base cap. In preferred embodiments, the inner wall 48 is uniformly spaced inwardly from the outer wall 36. In the embodiment illustrated in FIGS. 1 and 2, the inner wall 48 has a length slightly less than the length of the outer wall 36. Internal threads 50 are provided on the inner surface of the inner wall 48 for mating with the threads 20 on the tube 10.

The base cap 32 is positioned on the tube 10 such that the nozzle 22 extends through the central opening 40 in the base cap 32 so that the threads 50 mate with the threads 20 on the tube. The base cap 32 is then screwed onto the tube until the nozzle 22 extends completely through the opening 40 and the lower edges of the inner wall 48 and the outer wall 36 engage the shoulder 16 of the tube 10. In the embodiment of FIGS. 1 and 2, when the base cap 32 is fully seated on the tube 10, the lip 42 of the central opening 40 in the base cap 32 snaps firmly in the annular groove 26 in the nozzle 22. Preferably, the lip 42 forms a tight fit against the nozzle 22. The snap connection between the lip 42 and the groove 26 also resists the base cap from inadvertently unscrewing from the tube. The base cap 32 can be removed from the tube by manually unscrewing the base cap with sufficient force so that the threads 20 and 50 urge the base cap 32 away from the tube until the lip 42 unsnaps from the annular groove 26.

The outer cap lid 34 is coupled to the base cap 32 by a living hinge assembly 52. The outer cap lid 34, as shown in FIG. 2, has a cylindrical outer wall 54 complementing the outer dimension of the base cap 32 such that the walls 54 and 36 are flush with each other when the cap lid 34 is closed. The outer wall 54 of the cap lid 34 terminates at a lower end 56 that is inclined with respect to a central axis of the cap lid 34 to complement the ledge 46 of the base cap 32. A top wall 58 connected to the outer side wall 54 defines an upper edge 60 which is substantially perpendicular to the central axis of the cap lid 34. An annular collar 62 depends from the inner surface of the top wall 58. The collar 62 is concentric with the central axis of the cap lid. An inner annular collar 64 is located inwardly from the collar 62. The annular collar 62 will contact the exterior surface of nozzle 22 while collar 64 contacts the inner surface. Preferably the collars 62 and 64 form a snap connection with the nozzle 22.

The closure 30 is assembled onto the nozzle substantially as shown in FIG. 1 by screwing the base cap 32 onto the threads 20 of the nozzle until the nozzle 22 extends through the opening 40 and the lip 42 is received in the annular groove 26. In preferred embodiments, the nozzle 22 is dimensioned to extend above the lip 42 about 0.2 to 1.5 cm. The cap lid 34 is hinged to pivot onto the base cap 32 and close the tube. The annular collar 62 on the cap lid 34 is dimensioned to engage the outer surface of the nozzle 22 to form a substantially fluid tight seal. The inner face of the outer wall 54 of the cap lid 34 includes detents 66 on the side portion and detent 67 on the front portion which snap fit over corresponding beads on ledge 46 of the base cap 32 and projection 68 to retain the cap lid 34 in a closed position. In addition, raised portion 73 on wall 71 adjacent the hinge serves to urge the rear wall portion of the cap lid 34 outwardly on closing so that detent 67 more positively latches into projection 68 of the base cap 32. The edge of the base cap 32 and the cap lid 34 each include a recessed area 69 and 70 respectively to assist in opening the cap lid 34.

When it is desired to dispense the contents of the tube, the cap lid 34 is flipped to the open position and a dispensing force is applied to the side walls of the tube to force the contents of the tube through the nozzle. The nozzle 22 extends from the base cap a distance to provide easy dispensing of the product. The top wall 58 of the cap lid 34 is inclined at an angle of about 5° to 15° and preferably about 10° from the axis of the base cap to permit easier dispensing from the tube. The top wall 58 of the cap lid 34 is slightly concave and dimensioned so that the tube 10 is able to stand upright on the top wall. This enables the tube to stand upright while not in use to minimize storage space. The closure can be used by flipping the cap lid to the open position or alternatively by unscrewing the closure from the tube in a manner similar to conventional screw caps to satisfy the personal preference of the consumer.

The cap lid 34 is attached to the base cap 32 by the living hinge assembly 52. The base cap 32 has an arcuate wall section 71 adjacent the hinge 52 which extends upwardly from the outer wall 36 above the top wall 44. As illustrated in FIG. 3, the wall section 71 has two step portions 72 and 74 spaced beside a higher step portion 76. A primary stabilizing living hinge 78 connects the step 76 to the cap lid 34. A pair of snap hinge members 80 and 82 are connected between the steps 72 and 74 and the cap lid 34. Each snap hinge member includes an elongated portion 84 having side edges 86, 88 which are vertically oriented with respect to the base cap when the cap lid 34 is in the closed position. The ends of the elongated portion 84 are connected to the step 72 and to the cap lid respectively to form living hinges 90 and 92'. Each snap hinge member 80, 82 is constructed in a similar manner.

Figure 7:
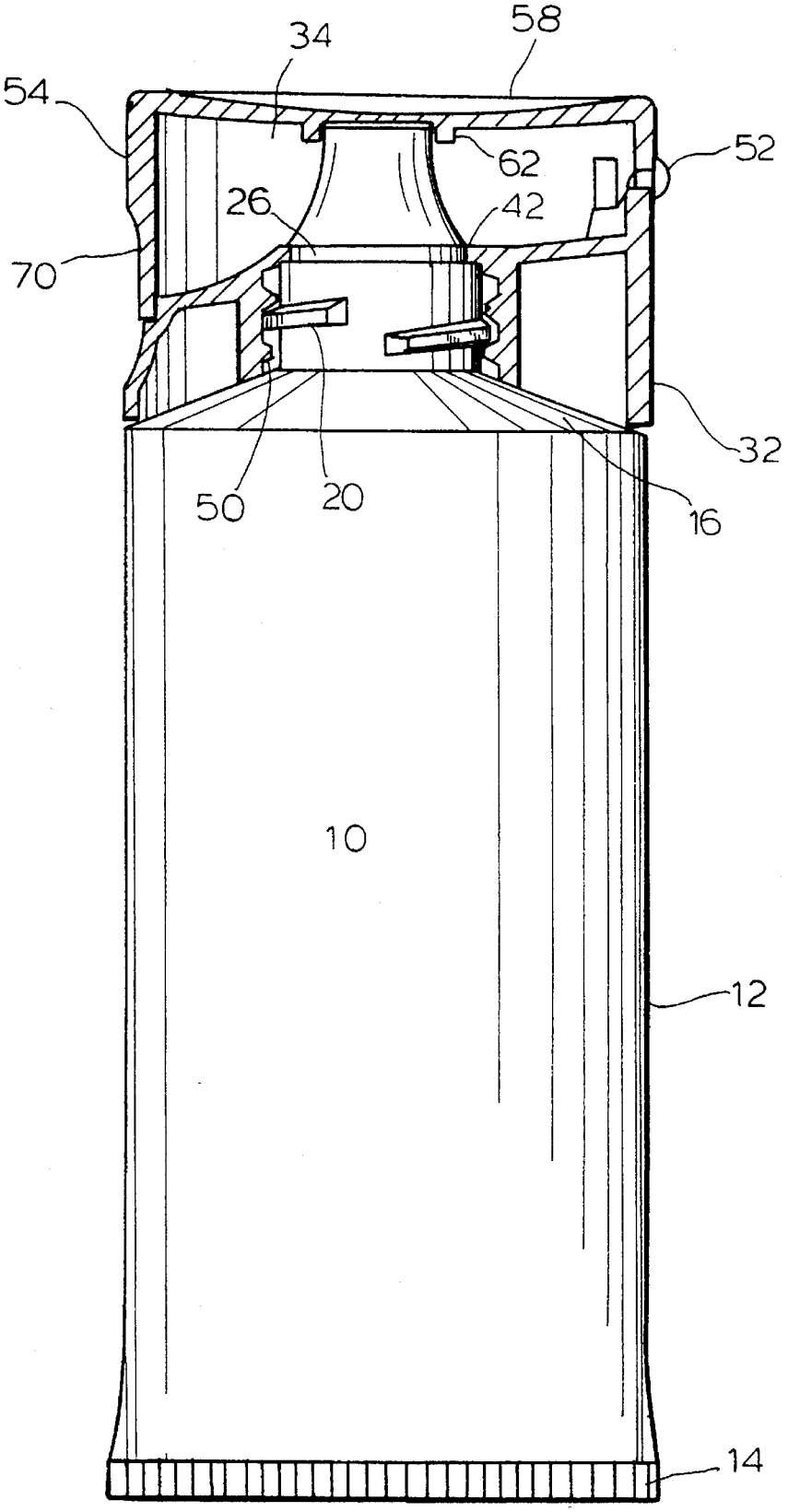
FIG. 7 is a partial side cross-sectional view of the cap lid of FIG. 1 in the closed position.

The arrangement of the hinges 78, 80 and 82 provide a smooth appearance when the outer cap is in the closed position such that the hinges are substantially flush with the side walls 36 and 54 as shown in FIG. 7. In operation, the cap lid 34 pivots with respect to the base cap 34 about the center hinge 78 which defines the pivotal axis of the cap lid. Since the snap hinges 80 and 82 are spaced from center hinge 78 along the perimeter of the base cap, the hinges 80 and 82 provide an over-center snap action. When the cap lid 34 is pivoted away from the base cap beyond the point where the snap hinges 80 and 82 are in the same plane with the center hinge 78, the cap lid will snap to the open position. Similarly, when the cap lid is pivoted toward the base cap beyond the same point, the cap lid will snap to the closed position.

This closure is not restricted to any particular hinge type. This can be of the three strap type as is shown in the drawings or it can be a film hinge as is shown in U.S. Pat. No. 4,403,712.

Embodiment of FIGS. 4 and 5

In a further embodiment of the invention shown in FIGS. 4 and 5, the tube 100 includes a flexible and collapsible side wall 102 connected to a frusto-conical shoulder 104. A cylindrical section 106 extends from the shoulder 104 and is concentric with the central axis of the tube 100. Threads 108 are provided on the outer surface of the cylindrical section 106 to couple the tube with the closure 110. A nozzle 112 extends from the cylindrical section 106 and is concentrically positioned with respect to the central axis of the tube. The upper end of the nozzle 112 includes an outwardly extending radial lip to define an annular groove 114.

The closure 110 comprises a base cap 116 and a cap lid 18 connected together by a hinge assembly 120. The base cap 116 includes an outer annular wall 122 depending from a top wall 124. The outer wall 122 has a dimension complementing the dimension of the tube 100 so that the outer wall 122 is substantially flush with the tube when assembled on the tube. An inner annular wall 126 is spaced inwardly from the outer wall and concentric to the outer wall. The inner wall 126 includes threads 128 complementing the threads 108 of the tube 100 for attaching the base cap to the tube.

The top wall 124 defines a conduit 130 disposed transversely with respect to the axis of the base cap 116. The conduit 130 in the top wall defines an annular inlet opening 132 that is concentric to the axis of the base cap 116 and the inner and outer walls 126 and 122. As shown in FIG. 4, an annular collar 134 extends inwardly and is concentric to the inner wall 126. A lip 136 extends radially inwardly from the lowermost end of the collar 134. The conduit 130 terminates at an upwardly extending nozzle 138 which extends above the top wall 124 of the base cap 116.

The conduit 130 as shown in FIG. 4 defines an axial inlet channel 140, a substantially horizontal channel 142, and an axial outlet channel 144. The inlet channel 140 is positioned coaxially with the inner wall of the base cap. The outlet channel 144 and the nozzle 138 are offset from the central axis of the base cap toward the peripheral edge to assist in ease of dispensing the contents of the tube 100. The top wall 124 is preferably inclined with respect to the central axis of the base cap to further assist in the dispensing of the contents of the tube. In the embodiment of FIG. 4, the top wall 124 slopes downwardly from the hinge assembly 120 to the opposite side of the cap. Preferably, the outlet nozzle 138 and the outlet channel 144 are positioned opposite the hinge assembly 120.

The outer wall 122 includes a ledge portion 146 around the periphery of the base cap 116. A wall section 148 extends above the top wall 124 to support the hinge assembly 120.

The cap lid 118 is substantially similar to the cap lid of the embodiment of FIG. 1 except for the annular collar 150 being spaced from the central axis of the outer cap to accommodate the offset nozzle 138. An inwardly directed rib 152 engages the end of nozzle 138 when the cap is in the closed position to seal the outlet channel 144. Components of the outer cap 118 and the hinge assembly 120 which are similar in structure and function to the embodiment of FIG. 1 are designated by the same reference numbers with the addition of a prime.

In use, the base cap 116 is assembled onto the threaded cylinder 116 of tube 100. The base cap 116 is screwed onto the threads 128 to force the base cap 116 into the seated position shown in FIG. 4. Screwing the base cap 116 onto the threads 128 causes the lip 136 of the inlet collar 134 to snap into position in the annular groove 114 of the nozzle and provide a liquid tight seal. As shown in FIG. 4, the upper end of the nozzle 112 is essentially flush with the lower surface of the horizontal channel 142. In this embodiment, the end of the nozzle 112 is below the upper surface of the base cap 116. Once the base cap is seated on the nozzle, the contents of the tube can be dispensed by squeezing the sides of the tube to force the contents through the nozzle 112 and the channel to the discharge nozzle 138. The cap lid 118 being connected to the base cap 116 by the snap hinge is closed by pivoting the cap lid 118 to seat on the base cap. In the closed position, the edge of the cap lid 118 seats against the inclined ledge of the base cap. The collar seats against the nozzle to seal the opening.

Figure 6:
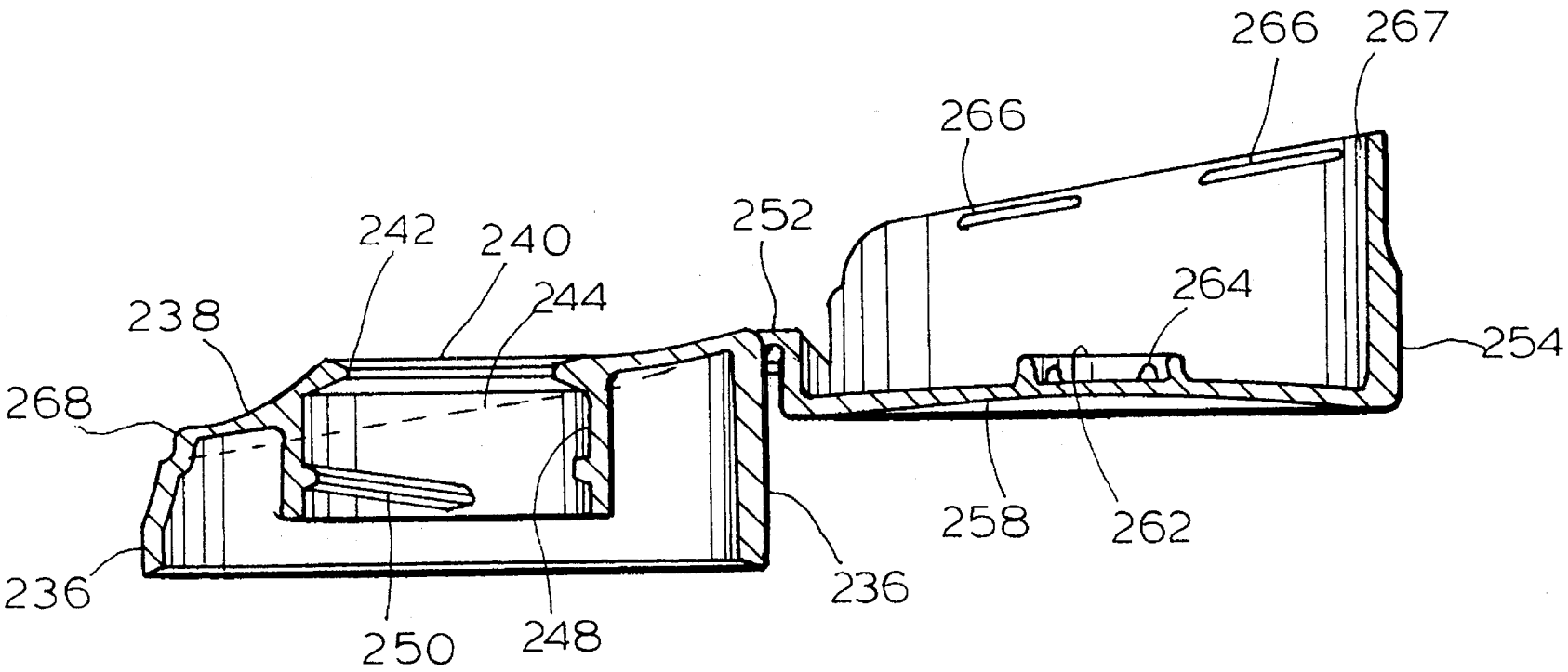
FIG. 6 is a cross-sectional view of an alternative embodiment of the invention showing the hinge assembly.

Embodiment of FIG. 6

The embodiment of FIG. 6 differs from that of FIGS. 1–3 in that the hinge between the base cap and the cap lid is not elevated above the base cap but rather is a continuation of the top wall of the base cap. If the hinge used is a three strap hinge as in FIGS. 1–4, the two end straps may be attached to the base cap slightly below the top wall of the base cap. This is a common construction for such a hinge where the hinge is essentially an extension of the top walls. This embodiment has some structural advantages over the elevated embodiment of FIGS. 1–4. In this embodiment, the living hinge assembly 252 is essentially an extension of upper wall 238. Dependent from the upper wall is cylindrical wall 236. The spout of the tube extends up through central opening 240 which is defined by annular lip 242. The cap lid has a cylindrical wall 254 and a top wall 258. There are also shown annular collars 262 and 264. Detents 266 and 267 function to hold the outer cap in a closed position with detent 267 interlocking with projection 268. The hinge construction is essentially the same as in the embodiment of FIGS. 1–5.

Figure 8:
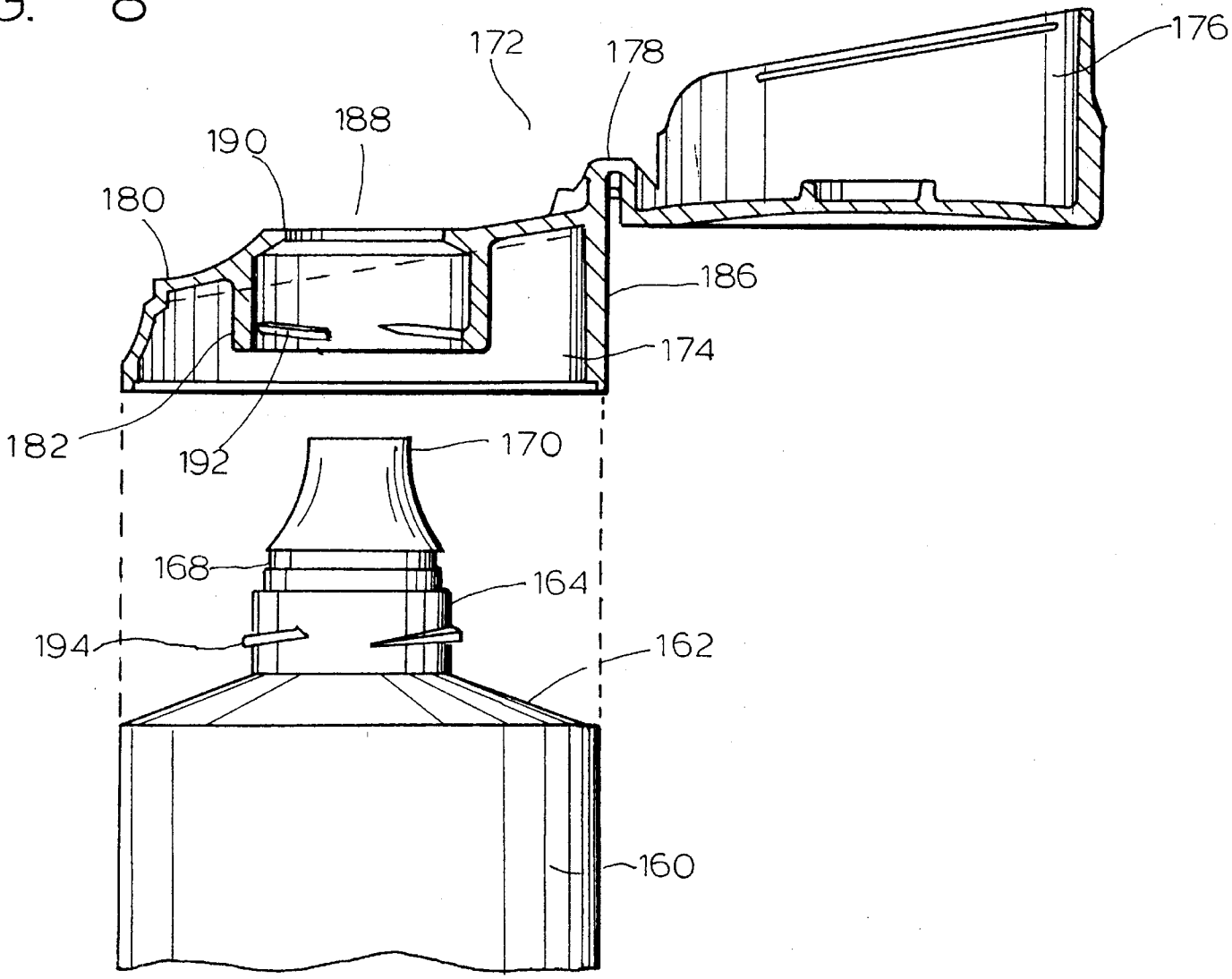
FIG. 8 is a cross-sectional view of a further alternative embodiment of the invention showing the camming arrangement.

Embodiment of FIG. 8

A further embodiment is shown in FIG. 8 which includes a camming arrangement to attach the cap to the container. The tube 160 and the closure assembly 172 is similar to the embodiment of FIG. 1 except for the threads on the base cap and nozzle.

In the embodiment of FIG. 8, the tube 160 includes a conical shoulder 162 and a cylindrical collar 164. The axial end of the collar 164 includes an annular groove 168 and a conical dispensing nozzle 170. The closure 172 includes a base cap 174 and an cap lid 176 connected together by a living hinge assembly 178. The base cap comprises a top wall 180, an inner depending wall 182 and an outer depending wall 186 in a manner similar to the embodiment of FIG. 1. An axial opening 188 extends through the top end wall. An inwardly extending annular rib 190 extends around the opening 188.

The inner wall 182 has an inner surface having camming elements 192 inclined with respect to the central axis of the cap. As shown in FIG. 8, the cam elements have angled faces. The cylindrical collar 164 of the tube includes complementing camming elements 194. The camming elements 192 and 194 are integrally molded in the tube and cap respectively. As shown in FIG. 8, the camming elements function as conventional threads to screw the base cap onto the tube so that the nozzle extends through the opening 188 and the rib 190 snaps into the annular groove 168 of the nozzle. The camming elements are sufficiently flexible such that once the nozzle is seated in the opening 188, further rotation of the cap with respect to the nozzle will cause the camming elements to snap past each other. Rotating the closure counter-clockwise engages cams 192 of the closure and cams 194 of the tube which lift the closure disengaging the rib 190 from the annular groove 168. Once the rib 190 is separated from the annular groove 168, the closure can be easily unscrewed from the nozzle. The camming elements in this embodiment allow the closure to be rotated in the clockwise direction to any desired position on the nozzle without risk of over tightening or the base cap unscrewing from the tube.

The closure in preferred embodiments is made of molded plastic material as a unitary piece. Suitable plastic materials include, for example, polyolefins such as polyethylene, polypropylene and copolymers thereof. Typically, the caps are formed by injection molding.

The tube is similarly formed from a suitable plastic material such as polyolefins. In preferred embodiments, the nozzle, shoulder and body of the tube are molded as an integral assembly. The tube and closure are particularly suitable for most viscous materials such as toothpaste where small amounts are dispensed at a time. The closure provides a convenient and efficient means for attaching a closure to a tube so that the tube can be closed after each use.

The closure may also be removed from the tube when the contents of the tube have been consumed. The closure may be removed from the nozzle of the tube by rotating the base cap with respect to the tube such that the threads unscrew the base cap from the tube and releases the lip of the base cap from the groove in the nozzle. In this manner, the closure can be used again on another tube.

The above description is provided to illustrate advantageous embodiments of the invention. It will be understood by those skilled in the art that various changes and modifications can be made without departing from the spirit and scope of the invention as defined in the appended claims.

What is claimed is:

1. A closure for use with a container having a dispensing nozzle; said closure comprising:

a base cap having a central axis, a substantially planar base top end wall having an aperture, a first annular wall depending from the peripheral edge of said aperture and defining a central channel to receive a nozzle of a container, and an annular outer side wall depending from a peripheral edge of said base top end wall, said base top end wall at the peripheral edge of said aperture having an inwardly extending radial lip for removably interlocking with a groove on said nozzle of said container and being angled with respect to the central axis to facilitate the delivery of product, said first annular wall having means for removably attaching said base cap to the nozzle of said container; and a cap lid hinged to said base cap by a living snap hinge integrally formed with said base cap, said cap lid having a cap top end wall, an annular side wall and an annular seal ring depending from said cap top end wall and being concentric to a central axis of said cap lid, said cap lid being hinged to said base cap so that said annular seal ring seals said nozzle when said cap lid is in a closed position.

2. The closure of claim 1, said first annular wall has threads on an inner surface thereof for mating with threads on said container for securing said closure to said container.

3. The closure of claim 1, wherein said seal ring engages and seals an outer surface of said nozzle of said container when the cap lid is in a closed position.

4. The closure of claim 1 said living snap hinge comprising a first hinge means attached to an outer edge of said base top end wall and to an outer edge of said cap lid for defining a pivotal movement of said cap lid with respect to said base cap from an open position to a closed position; first and second snap hinge means on said outer edge of said base top end wall and being connected to said cap lid, said first and second snap hinge means being radially disposed on opposite sides of said first hinge means.

5. The closure of claim 4, said first and second snap hinge means, each comprising an elongated portion having a first end hinged to said outer edge of base said top end wall and a second end hinged to said cap lid.

6. The closure of claim 5, said first and second ends of each of said first and second snap hinge means being axially spaced from said first hinge means with respect to said central axis of said base cap.

7. A container and removable closure assembly, the combination comprising:

a container having a dispensing nozzle, said nozzle having a closure attachment means and an interlocking annular groove on an outer surface thereof:

a closure including a base cap and a cap lid hinged to said base cap by a hinge means, said base cap having substantially planar base top end wall, a first annular wall depending from said base top end wall defining a central axis, said first annular wall having attachment means on an inner surface thereof for interconnecting with the closure attachment means on said nozzle, said base top end wall angled with respect to the central axis to facilitate the delivery of product and including an aperture defined by said first annular wall having an inwardly extending annular rib concentric with said central axis, said nozzle of said container extending above said base top end wall and being disposed within said aperture with said annular rib removably interlocking with said annular groove whereby said container can be opened by rotating the cap lid with respect to the base cap by means of said hinge and in the alternative by disengaging the closure attachment means on said nozzle from the attachment means on said first annular wall along with removing said annular rib from said annular groove.

8. The assembly of claim 7, said annular groove on said nozzle of said container being spaced from an axial end of said nozzle.

9. The assembly of claim 7, said the inner surface of first annular wall having threads thereon for removably coupling said base cap to said nozzle.

10. The assembly of claim 9, said closure attachment means including threads on an outer surface of said nozzle for mating with said threads on said inner surface of said first annular wall.

11. The assembly of claim 7, further comprising a second annular wall depending from said base top end wall and being concentric with said first annular wall, said second annular wall having a dimension approximating an outer dimension of said container.

12. The assembly of claim 7, wherein said nozzle has an upper edge defining an outlet from said container, and said cap lid includes an annular seal means depending from an inner surface of a cap top end wall thereof, said annular seal means complementing said outlet and being disposed whereby said annular seal means closes the outlet in the nozzle when said cap is in a closed position.

13. The assembly of claim 12, wherein said annular seal means is an annular ring and seats outside said outlet of the nozzle when the cap is in the closed position.

14. The assembly of claim 7, said container being a collapsible container.

15. The assembly of claim 7, wherein said container is a tube.

* * * * *